US005201557A

United States Patent [19]

Schlack

[11] Patent Number: 5,201,557

[45] Date of Patent: Apr. 13, 1993

[54] SLIDE FASTENER

[75] Inventor: Richard E. Schlack, Unionville, Pa.

[73] Assignee: Southco, Inc., Concordville, Pa.

[21] Appl. No.: 764,897

[22] Filed: Sep. 24, 1991

[51] Int. Cl.[5] ..... E05C 00/00

[52] U.S. Cl. ..... 292/161; 292/DIG. 31; 292/188

[58] Field of Search ..... 292/143, 161, 173, 181, 292/188, 160, DIG. 31

[56] References Cited

U.S. PATENT DOCUMENTS

| | | | |
|---|---|---|---|
| 1,438,547 | 12/1922 | O'Connor | 292/161 |
| 1,590,441 | 6/1926 | Piggot | 292/161 |
| 3,341,239 | 9/1967 | Wheeler | 292/181 X |
| 3,367,698 | 2/1968 | Walker, Sr. | 292/188 |
| 4,436,329 | 3/1984 | Metzger | 292/150 |
| 4,511,166 | 4/1985 | Weinerman | 292/29 |
| 4,638,649 | 1/1987 | Chao | 292/DIG. 31 X |
| 4,693,503 | 9/1987 | Bisbing | 292/210 |
| 4,844,518 | 7/1989 | Pritchard | 292/28 |
| 4,911,487 | 3/1990 | Rachocki | 292/216 |
| 4,948,181 | 8/1980 | Pritchard | 292/43 |

*Primary Examiner*—Richard E. Moore
*Attorney, Agent, or Firm*—Paul and Paul

[57] ABSTRACT

A slide fastener secures a door of an electrical cabinet to the cabinet frame. The slide fastener releaseably retains the door against the frame when the door and the frame are latched together. The slide fastener includes a door assembly secured to the door and slide keepers attached to the frame. The door assembly includes a lever assembly and a slide assembly. The lever assembly is rotatable between an open position and a closed position and engages and slides the slide assembly in response to rotation of the lever assembly. The slide assembly engages the slide keepers as the lever assembly is rotated.

7 Claims, 4 Drawing Sheets

SLIDE FASTENER

BACKGROUND OF THE INVENTION

1. Field of the Invention

The present invention relates generally to latching devices and more particularly to slide fasteners for fastening hinged doors, panels and the like.

2. Brief Description of the Prior Art

Various types of fastening devices for fastening doors, panels and the like are known.

Some types incorporate a spring to bias a latch bolt into a latched position about a keeper. Rotary handles are provided so the latch bolt may be rotated away from the keeper in opposition of the spring, and into an unlatched position. However, the handle of such a latch which extends beyond the body may cause inadvertent latching and unlatching in response to impact forces.

In U.S. Pat. No. 4,693,503, a lever latch is shown comprising a flanged housing, a handle and a latch which are inserted within an opening in a door. The handle and latch are positioned substantially flush with the outer door surface when the handle and the latch are in the latched position. The handle is provided with an arm and a stop for engagement with an inner surface of a cabinet frame when the door is closed and latched. However, the arm and stop portions of the lever latch which extend inward from the handle may prevent use of the device in certain confined areas. In addition, the mounting of the lever latch on the inside of the outer seal of the cabinet may require that additional sealing be applied to the latch.

There is a need for a latch which will fit and operate in a very small area, and which may be mounted outside of an outer seal of a cabinet.

SUMMARY OF THE INVENTION

The present invention provides a slide fastener for securing a door of an electrical cabinet to the cabinet frame. The slide fastener releaseably retains the door against the frame when the door and the frame are latched together. The slide fastener includes a door assembly secured to the door and at least one slide keeper attached to the frame. The door assembly includes a lever assembly and a slide assembly. The lever assembly is rotatable between an open position and a closed position and includes means for engaging and sliding the slide assembly in response to rotation of the lever assembly. The slide assembly includes at least one locking means for engaging a respective at least one slide keeper. In addition, the lever assembly can further comprise means for securing the lever assembly in a closed position, as well as means for disengaging the lever assembly, and biasing means for urging the lever from the closed position to the open position when the lever assembly is disengaged, so that the when the slide fastener is mounted flush with the surface of the cabinet door, the lever assembly can pop out enough when released so that it can be grasped by an operator and rotated to a fully open position.

DETAILED DESCRIPTION

Figure 1:
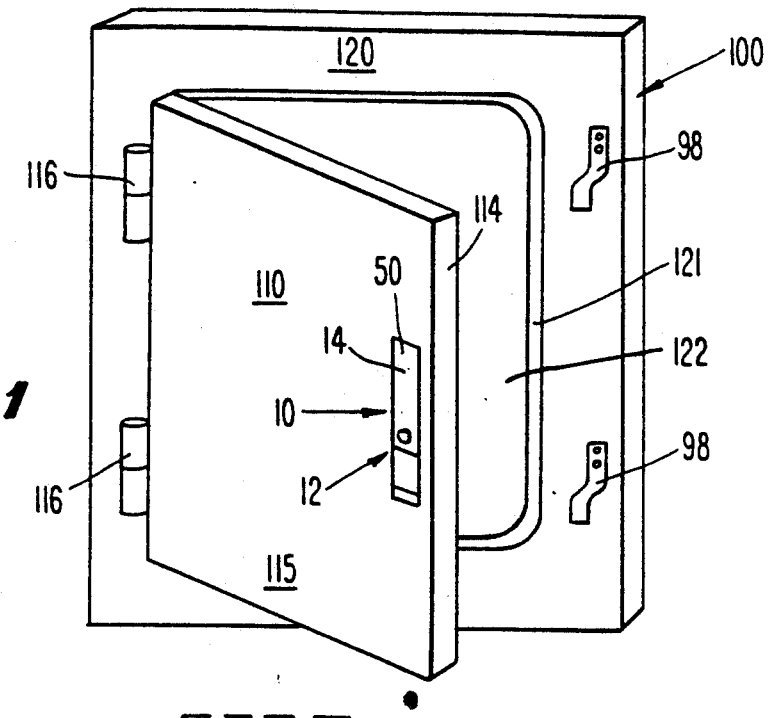
FIG. 1 is a perspective view of a slide fastener of the present invention shown mounted in the door of an electrical cabinet for securing the door to the frame of the cabinet, the door being shown in an open position.

Referring now to the drawings in detail, wherein like reference numerals indicate like elements throughout the several views, there is shown in FIG. 1 a perspective view of an electrical cabinet 100 having a slide fastener 10 of the present invention mounted in the open door 110 thereof. The electrical cabinet 100 is fabricated from steel to securely enclose electrical equipment (not shown). The door 110 is hinged to a frame 120 of the electrical cabinet 100. A gasket (not shown) is affixed to the inside of the door 110 proximate the edge of the door 110 for sealing the door 110 to the frame 120. The frame 120 surrounds an opening 122 for access to electrical equipment inside the cabinet 100. A recessed lip 121 in the frame 120 surrounding the opening 122 contacts the door gasket when the door 110 is closed and latched (not shown).

The slide fastener 10 includes a door assembly 12 mounted on the door 110 and a pair of slide keepers 98 mounted on the frame 120. The slide keepers 98 are engaged by the door assembly 12 when the door 110 is closed to latch the door 110 against the frame 120.

Figure 2:
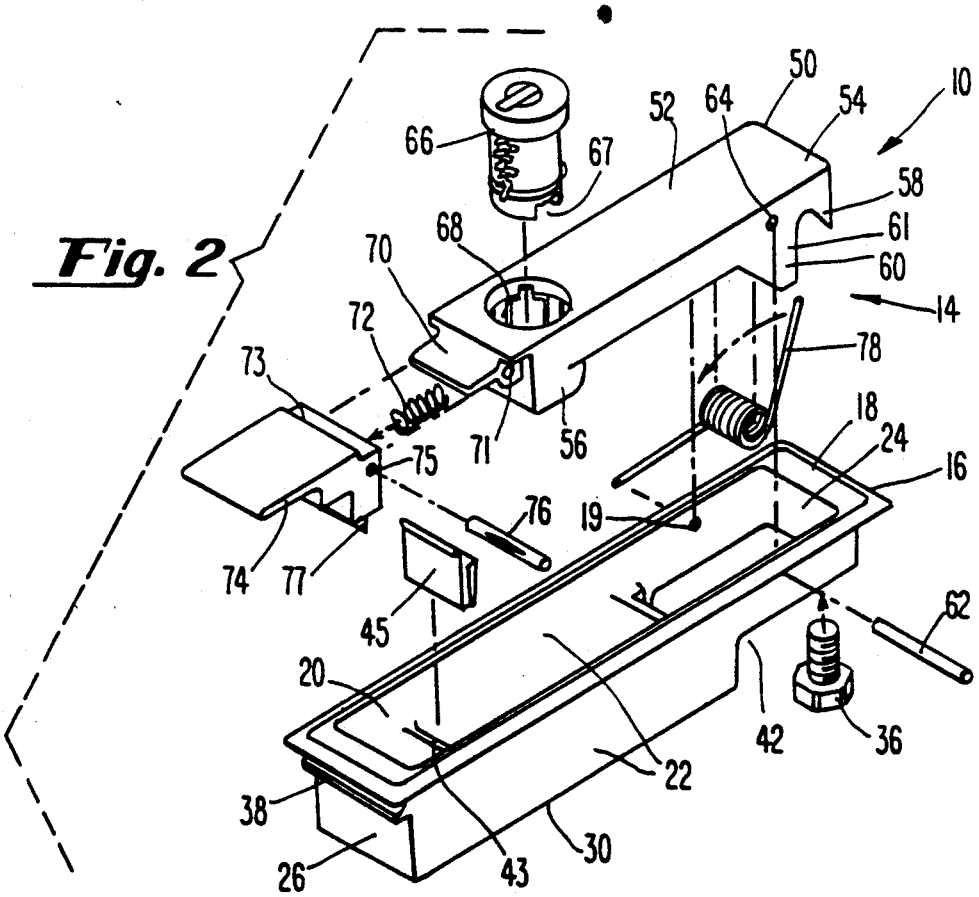
FIG. 2 is an exploded perspective view of the handle assembly of the slide fastener shown in FIG. 1.

The door assembly 12 includes a handle assembly 14 shown in the exploded perspective view of FIG. 2. The handle assembly 14 is mounted in a rectangular aperture 112 (FIG. 3) formed proximate the edge 114 of the door 110 opposite the door hinges 116, as best seen in FIG. 1.

As shown in FIG. 2, the handle assembly 14 includes a housing 16 and a lever assembly 50 pivotably mounted in the housing 16. The elongated, generally rectangular, box-like housing 16 can be cast as a unit and is formed by a rectangular upper plate 18 having a generally rectangular opening 20 therein. A pair of generally parallel side walls 22 and first and second end walls 24, 26 extend perpendicularly inwardly from the inner or lower surface 28 of the upper plate 18, the side walls 22 being joined to the end walls 24, 26 and to a bottom plate 30 extending generally parallel to the upper plate 18.

Figure 3:
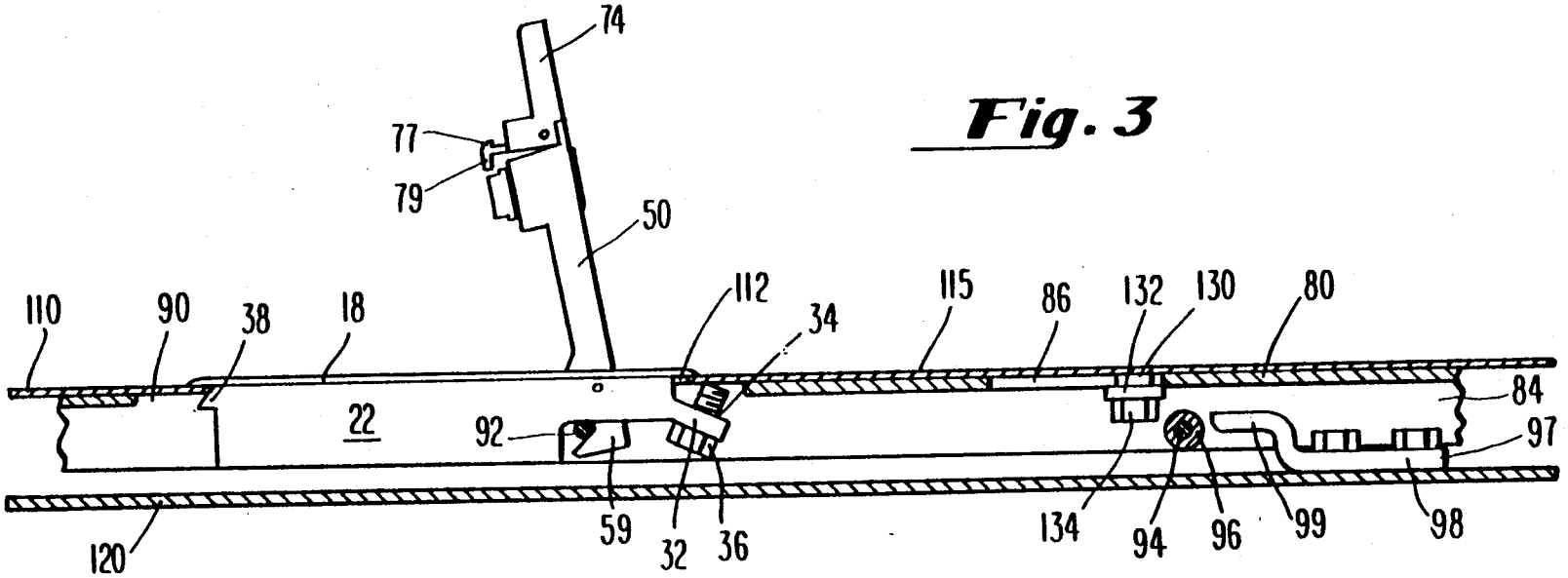
FIG. 3 is a fragmentary side sectional elevational view of the slide fastener of FIG. 1 shown in an open position.

As shown in the fragmentary side sectional elevational view of FIG. 3, a mounting bracket 32 extends from the outside of the first end wall 22. The mounting bracket 32 extends at an angle inclined slightly downwardly from a plane parallel to the upper plate 18 and has a threaded aperture 34 formed therethrough for receiving a threaded mounting bolt 36. On the second end wall 26 a mounting lip 38 is formed, the mounting lip 38 having a generally triangular cross-section and extending from the second end wall 26 immediately adjacent the inner surface 28 of the upper plate 18.

The opening 20 in the upper plate 18 and the side walls 22 and end walls 24, 26 enclose a well 40 in which the lever assembly 50 is housed when the slide fastener 10 is in the closed position. The aperture 112 in the door 110 is sized to receive the housing 26 of the handle assembly 14, the upper plate 18 extending around the aperture 112 in the door 110, and the inner surface 28 of the upper plate 28 abutting the outer surface 115 of the door 110 proximate the aperture 112 when the housing 16 is installed therein. A cutout 42 is formed in the lower portion of the housing 16 proximate the first end wall 24 to permit a portion of the lever assembly 50 to engage another portion of the door assembly 12 as described below. Extending upward into the well 40 from the bottom plate 30 and spaced from the second end wall 26 is a projection 43 for a purpose described below.

Figure 4:
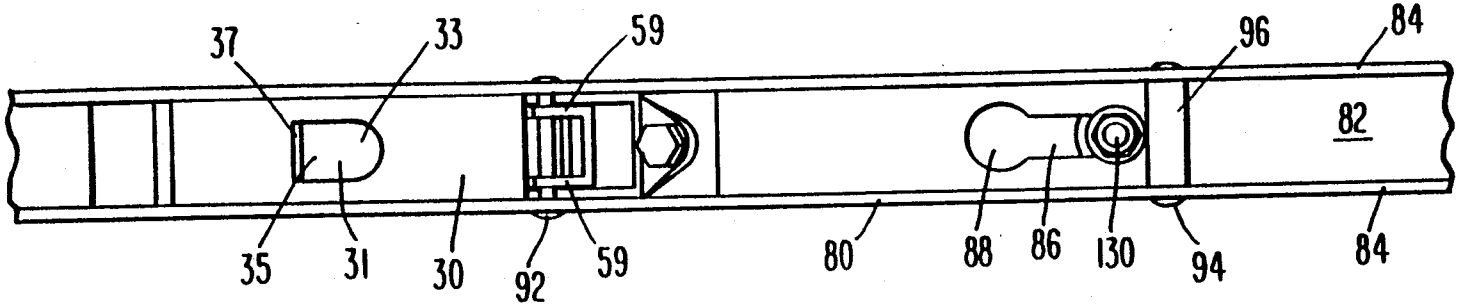
FIG. 4 is a rear plan view of the door assembly of the slide fastener of FIG. 3.

As best seen in the rear plan view of FIG. 4, the bottom plate 30 has an aperture 31 formed therein, the aperture 31 having a semicircular end 33 and a rectangular end 35, a keeper 37 for securing the lever assembly 50 when slide latch 10 is closed being formed adjacent the rectangular end 36 of the aperture 31 in the bottom plate 30.

The housing 16 is installed by positioning a portion of the door 110 adjacent the aperture 112 between the inner surface 28 of the upper plate 18 and the mounting lip 38, and then tightening the mounting bolt 36 to engage the inner surface 117 of the door 110, as best seen in FIG. 3. Because the bolt 36 is mounted at an angle, tightening the bolt 36 forces the housing 16 against the door 110 at the edge of the aperture 112 as well as securing the door between the bolt 36 and the upper plate 18.

As best seen in FIG. 2, the lever assembly 50 includes a handle 52 having a first end 54 and a second end 56. A first cam 58 and a second cam 60 each having a respective pair of parallel wings 59, 61 (only one of which is visible in FIG. 2) extend from the bottom or inner portion of the handle 52 at the first end 54. A pivot pin 62 is press fit through a pair of aligned apertures 19 formed in the housing 16 just above the cutout 42, the pin 62 extending through an aperture 64 formed in the first end 45 of the handle 52 and thereby pivotably mounting the lever assembly 50 in the housing 16.

A first spring or biasing means 78 is mounted on the pin 62 between the wings 61 of the second cam 60 to urge the lever assembly 50 to rotate about the pin 62 so and up out of the well 40 of the housing 16.

A conventional key lock cylinder 66 is mounted in a cylindrical aperture 68 formed in the second end 56 of the handle 52 for locking the slide fastener 10 when it is in the closed position. The lock cylinder 66 has a locking slot 67 formed in the lower end thereof for securing the lever assembly 50 in the housing 16 as described below.

A generally planar finger 70 extends from the second end 56 of the handle 52 and has an aperture formed therethrough at the base thereof for receiving a second pivot pin 76.

The lever assembly 50 also includes a push button 74 for latching and releasing the lever assembly 50 from the housing 16. The push button 74 is rotatably mounted on the second end 56 of the handle 52 by the second pivot pin 76, the ends of which extend through a pair of aligned apertures 75 formed in the push button 74. A second spring or biasing means 72 extends between the second end 56 of the handle 54 and the push button 74 to urge the push button 74 upward. The finger 70 extends within a step 73 formed in the push button 74 to limit the rotational freedom of the push button 74 about the second pivot pin 76 to a few degrees or so. The push button 74 also includes a catch 77 formed at the bottom thereof for engaging the keeper 33 formed in the housing 16. In addition, as best seen in FIG. 3, the push button 74 includes a tongue 79 extending forward of the catch 77, the tongue 79 abutting against the lower end of the lock cylinder 66 when the slide fastener 10 is locked closed.

Mounted on the projection 43 in the well 40 of the housing 16 is an antivibration spring 45 for providing additional force urging the catch 77 of the push button 74 against the keeper 37 when the slide fastener 10 is closed.

Figure 6:
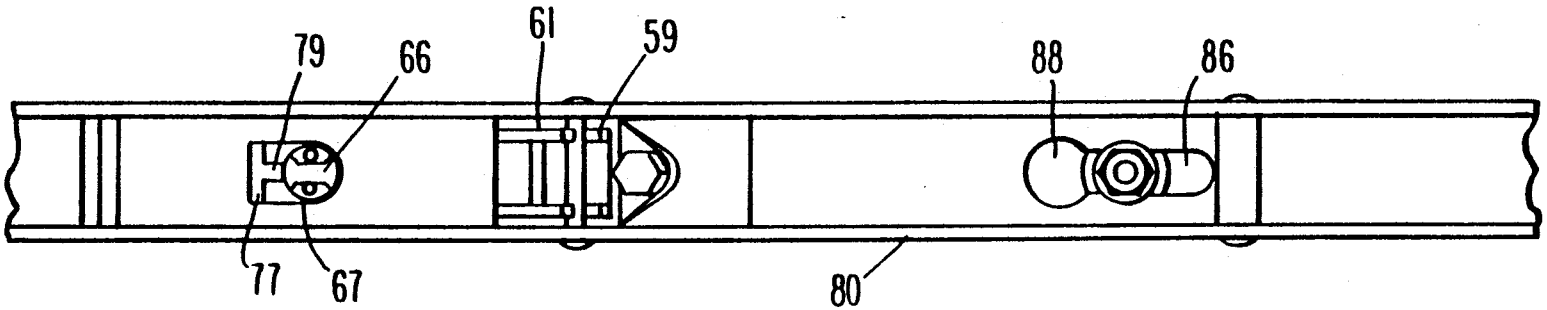
FIG. 6 is a rear plan view of the door assembly of the slide fastener of FIG. 5.

When the slide fastener 10 is closed and locked, as best seen in the rear plan view of FIG. 6, the lower portion of the lock cylinder 66 and the catch 77 of the push button 74 extend into the aperture 31 formed in the bottom plate 30 of the housing 16, the tongue 79 of the push button 74 abutting against the lock cylinder 66 and preventing rotation of the push button 74 about the second pivot pin 76. However, when a key is inserted into the lock cylinder 66 and the cylinder 66 is rotated ninety degrees, a release slot 67 formed in the bottom of the locking cylinder 66 is oriented toward the tongue 79 (not shown). The push button 74 can now be depressed by an operator, against the force exerted by the second spring 72, the push button 74 rotating about the second pivot pin 76, the catch 77 disengaging from the keeper 37, as the first spring 78 urges the lever assembly 50 to rotate about the first pivot pin 62.

As best seen in FIGS. 3–6, the door assembly 12 also includes a slide assembly 80 fabricated from channel stock having a base plate 82 and a pair of parallel sides 84 and slidably attached to the inner surface 117 of the door 110 parallel to and proximate the edge 114 of the door 110 by a plurality of posts 130 having threaded ends (not visible) passing through respective slots 86 in the base plate 82 of the slide assembly 80. Friction-reducing washers 132 are secured on the threaded ends of the posts 130 by nuts 134, the slots 86 having enlarged ends 88 to permit the slide assembly 80 to be quickly installed on preassembled posts 130. The base plate 82 also includes a central rectangular aperture 90 sized and positioned to permit the housing 16 to be received between the sides 84 of the slide assembly 80 and sufficiently large to avoid contact between the base plate 82 and the housing 16 when the slide assembly 82 is moved by the lever assembly 50.

Figure 5:
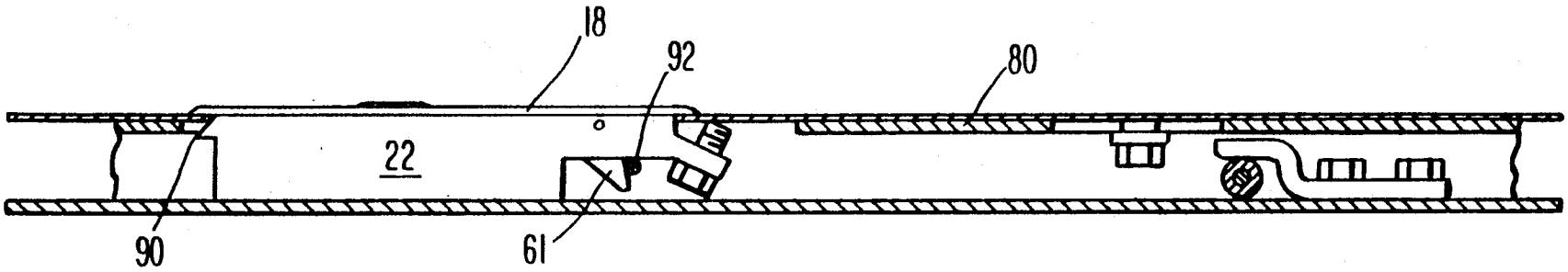
FIG. 5 is a fragmentary side sectional elevational view of the slide fastener of FIG. 1 shown in a closed position.

The slide assembly 80 includes a first rod 92 extending bewteen and perpendicular to the sides 84 and positioned to be engaged by the legs 59 of the first cam 58 when the slide assembly 10 is being opened and by the legs 61 of the second cam 60 when the slide fastener 10 is being closed, as best seen by comparing FIG. 3 with FIG. 5 and FIG. 4 with FIG. 6. When the slide fastener 10 is mounted as shown in FIG. 1, the slide fastener 10 is opened by unlocking the lock cylinder 66 with a key as described above and depressing the push button 74 to release the catch 77 from the keeper 37, the first spring 78 rotating the lever assembly 50 sufficiently out of the well 40 to permit it to be grasped and rotated further upward and outward by the operator. As the lever assembly 50 is rotated, the legs 59 of the first cam 58 contact the first rod 92, pushing the slide assembly 80 downward.

Figure 7:
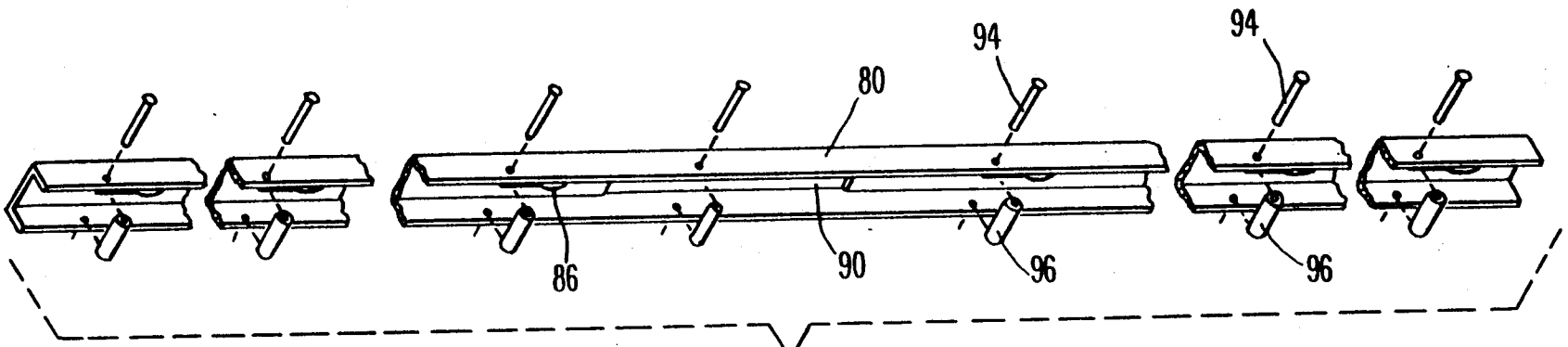
FIG. 7 is a fragmentary, exploded perspective view of a slide assembly of an alternative embodiment of the slide fastener of the present invention.

The slide assembly 80 also includes a plurality of spaced second rods 94 extending between and perpendicular to the sides 84, each second rod 94 having a respective rotatable sleeve 96 mounted thereon for contacting a respective "s"-shaped slide keeper 98 having a first leg 97 thereof bolted to the frame 120 of the cabinet 100. As best seen by comparing FIG. 3 and FIG. 5, the second leg 99 of the slide keeper 98 has a camming-surface formed thereon such that as the slide fastener 10 is closed, and the slide assembly 80 is forced upward through engagement of the first rod 92 by the legs 61 of the second cam 60, the sleeves 96 on the second rods 94 are forced under the second legs 99, thereby compressing the door gasket between the door 110 the frame 120 of the cabinet 110 and sealing the cabinet 100. As best seen in the fragmentary perspective view of FIG. 7, a large number of second rods 94 and respective sleeves 96 can be provided to secure doors of large dimensions.

It will be recognized by those skilled in the art that changes may be made to the above-described embodiments of the invention without departing from the broad inventive concepts thereof. It is understood, therefore, that this invention is not limited to the particular embodiments disclosed, but it is intended to cover all modifications which are within the scope and spirit of the invention as defined by the appended claims.

I claim:

1. A slide fastener for securing a door of an electrical cabinet to the cabinet frame, the door having an inner and an outer surface and an aperture formed therein proximate an edge thereof, the frame including an inner and an outer surface, the slide fastener releaseably retaining the door against the frame when the door and the frame are latched together, the slide fastener comprising a door assembly secured to the door and at least one slide keeper attached to the frame, the door assembly comprising:

a) a handle assembly including a lever assembly and a housing for rotatably mounting the lever assembly for rotation by an operator between a closed position to an open position;

(1) the housing including:

an upper plate having an opening formed therein and an inner surface, the inner surface of the upper plate abutting the outer surface of the door proximate the aperture when the slide fastener is mounted therein;

a pair of generally parallel side walls extending inward from the inner surface of the upper plate;

a pair of generally parallel end walls extending inward from the inner surface of the upper plate, the end walls being joined to the side walls;

a bottom plate joined to the side walls and an end wall, and generally parallel to the upper plate, the bottom plate having an opening formed therein; and a keeper securing the lever assembly when the lever assembly is in the closed position, the keeper extending outward from the bottom plate and through the side walls;

(2) the lever assembly including:

a handle having a first end and a second end, the first end pivotably attached to the housing, and a first cam and a second cam, the first and second cams extending inward from the first end and within the opening in the bottom plate of the housing;

a first biasing means engaging the first end of the handle and the housing, the first biasing means urging the second end of the handle away from the housing and the lever assembly from the closed position to the open position;

a button pivotably attached to the second end of the handle, the button having a lower surface and a catch formed thereon, the catch adapted to pass over and engage the keeper of the housing as the second end of the handle is pivoted by an operator toward the housing;

a second biasing means engaging the handle and the button, the second biasing means pivoting the button to a position in which the top surface of the button is flush with the top surface of the handle;

b) the slide assembly including:

a base plate having an opening formed therein for receiving the lever assembly, the base plate having at least one slot formed therein for slidably mounting the slide assembly on the inner surface of the door, the door having at least one slide post extending from the inner surface of the door and through the at least one slot;

a pair of generally parallel side plates extending from the base plate;

a cammed member extending between the side plates for engagement by the first and second cams of the lever assembly as the lever assembly is moved by an operator between the closed position and the open position, the slide being adapted for sliding movement in response to the rotation of the lever assembly; and at least one locking member extending between the side plates and adapted to engage a respective slide keeper mounted on the frame when the lever assembly is rotated from the open position to the closed position.

2. A slide fastener for securing a door of a cabinet to the cabinet frame, the door having an inner and an outer surface and an aperture formed therein proximate an edge thereof, the slide fastener releasably retaining the door against the frame when the door and the frame are latched together, the slide fastener comprising a door assembly secured to the door and at least one slide keeper attached to the frame, the door assembly including a handle assembly and a slide assembly, the handle assembly including a lever assembly and a housing for rotatably mounting the lever assembly for movement by an operator from a closed position to an opened position, the housing being mounted in the aperture in the door and extending therethrough, the lever assembly being rotatably between an open position and a closed position and including means for engaging and sliding the slide assembly in response to rotation of the lever assembly, the slide assembly being slidably mounted on the inner surface of the door and including at least one locking means for engaging a respective at least one slide keeper when the lever assembly is rotated from the open position to the closed position.

3. A slide fastener according to claim 2 wherein the slide assembly further includes a cammed member for engagement by the engaging and sliding means of the lever assembly for sliding the slide assembly in response to rotation of the lever assembly.

4. A slide fastener according to claim 3 wherein the lever assembly further comprises means for securing the lever assembly in a closed position, means for disengaging the lever assembly from the closed position, and a first biasing means for urging the lever from the closed position to the open position.

5. A slide fastener according to claim 4 wherein the housing includes a keeper for engagement by the securing means of the lever assembly for securing the lever assembly when the lever assembly is in the closed position.

6. A slide fastener for securing a door of a cabinet to the cabinet frame, the door including an inner and an outer surface and an aperture formed therein proximate an edge thereof, the frame including an inner and an outer surface, the slide fastener releasably retaining the door against the frame when the door and the frame are latched together, the slide fastener comprising a door assembly including a handle assembly and a slide assembly all being secured to the door and at least one slide keeper attached to the frame, the handle assembly including a lever assembly and a housing, the housing being mounted in the aperture in the door and extending therethrough, the lever assembly being rotatably mounted to the housing for movement between an open position and a closed position and including means for engaging and sliding the slide assembly in response to rotation of the lever assembly, the slide assembly being slidably mounted on the inner surface of the door adjacent the aperture thereof and including at least one locking means for engaging a respective at least one slide keeper when the lever assembly is rotated from the open position to the closed position, the slide assembly further including a cammed member for engagement by the engaging and sliding means of the lever assembly for sliding the slide assembly in response to rotation of the lever assembly, the lever assembly further including means for securing the lever assembly in a closed position, means for disengaging the lever assembly from the closed position, and a first biasing means for urging the lever from the closed to the open position, the housing further including a keeper for engagement by the securing means of the lever assembly for securing the lever assembly when the lever assembly is in the closed position.

7. A slide fastener according to claim 5, wherein the lever assembly includes first and second camming means, the first camming means engaging the slide assembly as the lever assembly is rotated in a first direction to slide the slide assembly from a closed position to an open position, the second camming means engaging the slide assembly as the lever assembly is rotated in a second direction to slide the slide assembly from an open position to a closed position.

* * * * *